US007097423B2

(12) United States Patent
Burdgick

(10) Patent No.: US 7,097,423 B2
(45) Date of Patent: Aug. 29, 2006

(54) ENDFACE GAP SEALING FOR STEAM TURBINE DIAPHRAGM INTERSTAGE PACKING SEALS AND METHODS OF RETROFITTING

(75) Inventor: Steven Sebastian Burdgick, Schenectady, NY (US)

(73) Assignee: General Electric Company, Schenectady, NY (US)

( * ) Notice: Subject to any disclaimer, the term of this patent is extended or adjusted under 35 U.S.C. 154(b) by 113 days.

(21) Appl. No.: 10/878,509

(22) Filed: Jun. 29, 2004

(65) Prior Publication Data

US 2004/0239051 A1 Dec. 2, 2004

Related U.S. Application Data

(63) Continuation-in-part of application No. 10/206,828, filed on Jul. 29, 2002, now abandoned.

(51) Int. Cl.
*F01D 11/02* (2006.01)

(52) U.S. Cl. ..... 415/173.7; 415/174.5; 415/230

(58) Field of Classification Search ..... 415/173.7, 415/171.1, 174.5, 230; 277/632, 637, 641, 277/642

See application file for complete search history.

(56) References Cited

U.S. PATENT DOCUMENTS

| | | | | |
|---|---|---|---|---|
| 3,393,894 | A | 7/1968 | Redsell | |
| 3,728,041 | A | 4/1973 | Bertelson | |
| 4,265,594 | A | 5/1981 | Eggmann | |
| 4,436,311 | A | 3/1984 | Brandon | |
| 4,537,024 | A | 8/1985 | Grosjean | |
| 4,749,333 | A | 6/1988 | Bonner | |
| 4,820,119 | A | 4/1989 | Joyce | |
| 5,002,288 | A | 3/1991 | Morrison et al. | |
| 5,154,577 | A | 10/1992 | Kellock et al. | |
| 5,158,430 | A * | 10/1992 | Dixon et al. | 415/134 |
| 5,224,822 | A | 7/1993 | Lenahan et al. | |
| 5,249,920 | A | 10/1993 | Shepherd et al. | |
| 5,271,712 | A | 12/1993 | Brandon | |
| 5,271,714 | A | 12/1993 | Shepherd et al. | |
| 5,429,478 | A | 7/1995 | Krizan et al. | |
| 5,524,340 | A | 6/1996 | Galbraith et al. | |
| 5,586,773 | A * | 12/1996 | Bagepalli et al. | 277/650 |
| 5,601,403 | A | 2/1997 | Galbraith et al. | |
| 5,624,227 | A | 4/1997 | Farrell | |
| 5,657,998 | A * | 8/1997 | Dinc et al. | 277/653 |
| 5,709,530 | A | 1/1998 | Cahill et al. | |
| 5,934,687 | A | 8/1999 | Bagepalli et al. | |
| 5,971,400 | A | 10/1999 | Turnquist et al. | |
| 5,980,204 | A | 11/1999 | Chevrette | |
| 6,077,034 | A | 6/2000 | Tomita et al. | |
| 6,394,459 | B1 | 5/2002 | Florin | |
| 6,722,850 | B1 * | 4/2004 | Burdgick | 415/230 |

* cited by examiner

*Primary Examiner*—Ninh H. Nguyen
(74) *Attorney, Agent, or Firm*—Nixon & Vanderhye P.C.

(57) ABSTRACT

Spline seals are disposed in circumferentially registering slots of adjacent arcuate packing seal segments disposed in grooves on inner hooks of a steam turbine diaphragm assembly. The spline seals extend in a gap between the endfaces of the segments and minimize or preclude steam leakage flows past the endfaces. The spline seals may be oriented in axial and circumferential directions to minimize leakage flow paths in a generally radial direction and/or may be inclined radially in a downstream direction to seal against steam leakage flow in an axial direction. The spline seals are disposed in the slots which may be formed as part of original equipment manufacture or may be machined in segments with spline seals provided as retrofits.

24 Claims, 4 Drawing Sheets

ENDFACE GAP SEALING FOR STEAM TURBINE DIAPHRAGM INTERSTAGE PACKING SEALS AND METHODS OF RETROFITTING

This application is a continuation-in-part of U.S. patent application Ser. No. 10/206,828, filed Jul. 29, 2002, now abandoned, the disclosure of which is incorporated herein in its entirety by reference.

BACKGROUND OF THE INVENTION

The present invention relates generally to diaphragm assembly interstage packing seals for steam turbines and particularly relates to segmented packing seals mounted on inner hooks of diaphragm assemblies and having spline seals for sealing the gap between the circumferentially adjacent endfaces.

A steam turbine has multiple stages. Each stage comprises a plurality of circumferentially spaced buckets about the turbine rotor and a plurality of nozzles forming part of diaphragm assemblies affixed to the stationary casing of the turbine. The nozzles and buckets are axially spaced from one another and disposed in the steam flow path. The diaphragm assemblies include inner hooks having dovetail-shaped grooves forming an annular groove for receiving interstage packing seals. The packing seals are mounted in the annular groove and carry axially spaced labyrinth teeth for sealing against the rotor. The packing seals are formed from arcuate segments disposed in the dovetail-shaped groove of the diaphragm assembly.

With steam turbine design, it is critical to minimize or eliminate any leakage paths within the turbine flow path and secondary leakage circuits. Because the packing seal segments are movable radially relative to the rotor, gaps appear between the endfaces of the segments and define steam leakage paths. These endface gaps can be sufficiently large to produce leakage between the high and low pressure regions on opposite sides of the diaphragm nozzles which can cause significant efficiency loss and loss of potential revenue for a power producer utilizing the steam turbine. The gap between adjacent seal segments is a result of the radial movement of the seal segments, machining tolerances, as well as thermal responses to the high temperature conditions during operation of the turbine. Accordingly, there is a need for seals in the endface gaps between packing seal segments in steam turbines to minimize or preclude steam leakage flows through the endface gaps.

BRIEF DESCRIPTION OF THE INVENTION

In accordance with a preferred embodiment of the present invention, there is provided in a steam turbine a diaphragm assembly having inner hooks mounting a plurality of arcuate interstage packing seal segments, each having labyrinth teeth for sealing against the turbine rotor. To minimize or eliminate steam leakage flow paths through the diaphragm assembly bypassing the steam flow path, one or more spline seals span between the adjacent endfaces of adjacent seal segments. One of the spline seals extends in generally axial and circumferential directions to seal against generally radial flow of the steam into the gap between the registering endfaces and between high and low pressure regions on opposite sides of the interstage packing seal segments. The second spline seal is disposed between the endfaces in generally radially outward inclined downstream and circumferential directions to preclude flow of leakage steam generally axially past the endface gap between adjacent segments. It will be appreciated that packing seal segments seal against an axial load surface on the inner hook axial surface on the downstream side of the packing seal. With the second spline seal extending substantially from the labyrinth seal with the rotor adjacent the high pressure side of the seal segments to adjacent the axial sealing surfaces between the seal segments and the load surface of the diaphragm assembly, and with the first spline seal sealing off radial flow between the endfaces, axial leakage flow is effectively minimized or prevented.

In a preferred embodiment according to the present invention, there is provided a steam turbine comprising: a rotor carrying a plurality of circumferentially spaced buckets and forming a part of a stage of a steam turbine; a diaphragm assembly surrounding the rotor including a plurality of nozzles and inner hooks and forming another part of the steam turbine stage; the inner hooks carrying a plurality of circumferentially extending packing seal segments about the diaphragm assembly for sealing between the rotor and the diaphragm assembly; each of the segments having endfaces respectively in circumferential registry with opposed endfaces of circumferentially adjacent segments, the endfaces including slots opening circumferentially and in general circumferential registration with one another, each the slot having a predetermined depth from the endface thereof; and a spline seal extending between each of the opposed endfaces of circumferentially adjacent packing ring segments and in the slots for minimizing or precluding steam leakage past the registering endfaces, the spline seal having a width less than the combined depths of the circumferentially registering slots of the opposed endfaces.

In a further preferred embodiment according to the present invention, there is provided a steam turbine comprising: a rotor carrying a plurality of circumferentially spaced buckets and forming part of a stage of a steam turbine; a diaphragm assembly surrounding the rotor including a plurality of nozzles and inner hooks and forming another part of the steam turbine stage; the inner hooks forming a circumferentially extending dovetail shaped groove carrying a plurality of circumferentially extending packing seal segments about the diaphragm assembly in the groove, the segments carrying labyrinth seal teeth for sealing about the rotor and being movable in a generally radial direction in the groove; each of the segments having endfaces respectively in circumferential registry with opposed endfaces of circumferentially adjacent segments, the endfaces including slots opening circumferentially and generally in circumferential registration with one another, each the slot having a predetermined depth from the endface thereof; and a spline seal extending between each of the opposed endfaces of circumferentially adjacent segments and in the slots for minimizing or precluding steam leakage flow past the registering endfaces, the spline seal having a width less than the combined depths of the circumferentially registering slots of the opposed endfaces.

In a further preferred embodiment according to the present invention, there is provided a turbine having a rotor, a diaphragm assembly surrounding the rotor and a plurality of circumferentially extending packing seal segments in circumferentially extending grooves about the diaphragm assembly for sealing between the diaphragm assembly and the rotor, a method of retrofitting the packing seal segments to provide seals between the opposed endfaces of adjacent packing seal segments comprising the steps of: removing the packing seal segments from the turbine; forming at least one slot in each endface of the removed packing seal segments to a predetermined depth from the endfaces thereof; disposing a spline seal in slots of opposed endfaces of the packing seal segments with the spline seal having a width less than the combined depths of the slots of the opposed endfaces; and inserting the packing seal segments into the grooves of the diaphragm assembly with at least one of the edges of the spline seal spaced from a base of one of the grooves whereby the spline seals extend between adjacent segments for minimizing or precluding steam leakage flows between the adjacent segments.

DETAILED DESCRIPTION OF THE INVENTION

Figure 1:
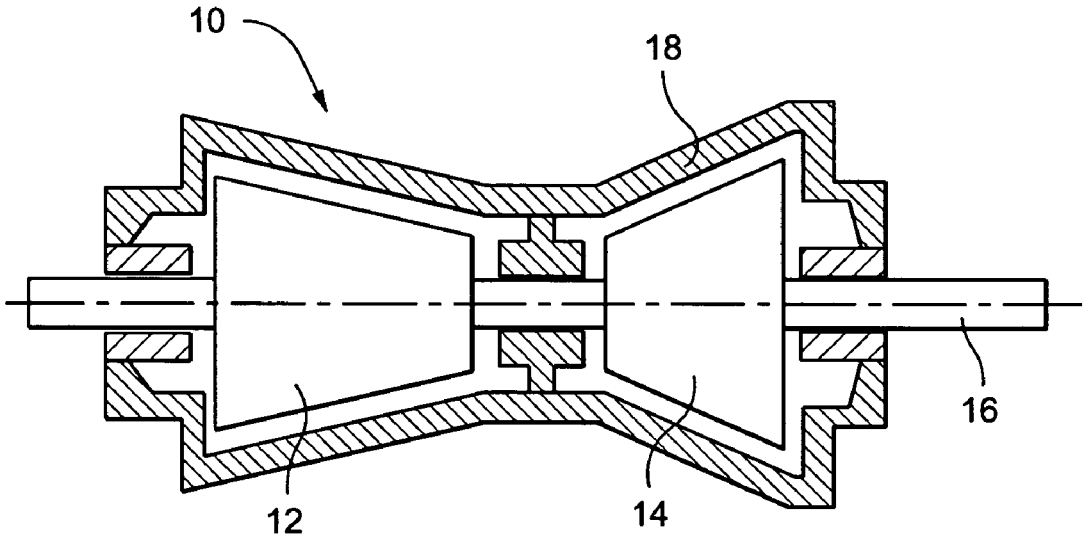
FIG. 1 is a schematic illustration of a steam turbine having high and intermediate pressure turbine sections.

Referring now to the drawings, particularly to FIG. 1, there is illustrated a steam turbine, generally designated 10, and in this example comprised of a high pressure turbine section 12 and an intermediate pressure turbine section 14 mounted on a single integral rotor 16, all disposed within an outer casing 18. It will be appreciated that the rotor 16 is driven in rotation by the high and intermediate pressure driven sections 12 and 14 while the casing 18 remains stationary. The present invention is applicable to not only high and intermediate pressure turbines but also low pressure turbine sections of a typical steam turbine unit and the illustration of the high and intermediate pressure sections in FIG. 1 is not intended to limit the present invention to those particular sections.

Figure 2:
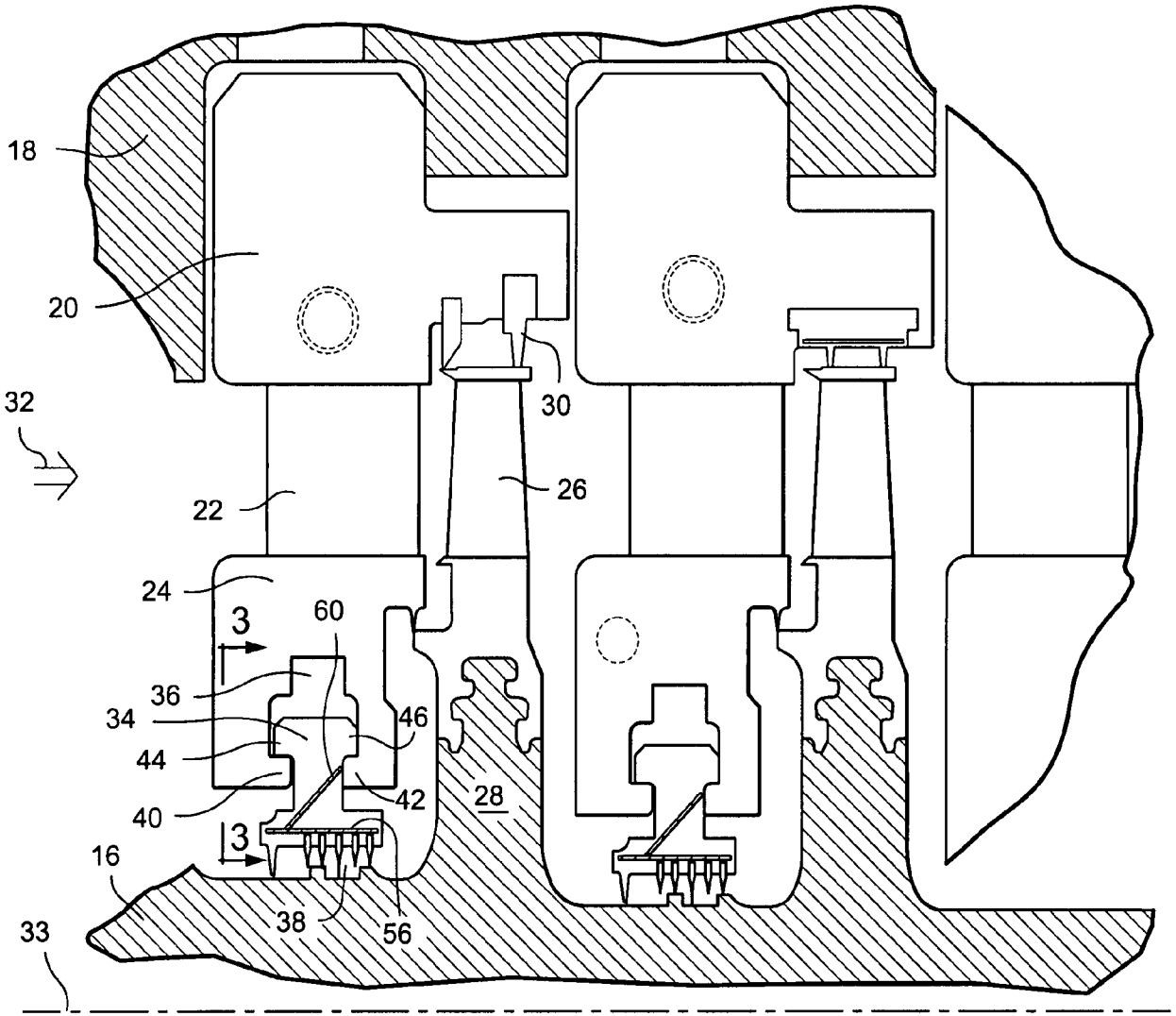
FIG. 2 is a fragmentary enlarged partial cross-sectional view through a rotor and diaphragm assembly illustrating spline seals in the endfaces of packing seal segments according to a preferred embodiment of the present invention.

Referring now to FIG. 2, two stages of a steam turbine are illustrated. Each stage includes a diaphragm assembly 20 including nozzles 22 and an inner hook 24. The nozzles 22 are located axially forwardly of buckets 26 mounted on wheels 28 forming part of the rotor 16. The tips of the buckets 26 are sealed by labyrinth seals 30 mounted in the diaphragm assemblies 20. The steam flow path is generally indicated by the directional arrow 32 whereby steam flows past the nozzles 22 and buckets 26 imparting rotation to the rotor 16 about a rotor axis 33. While only two stages of the steam turbine are illustrated, it will be appreciated that each set of axially adjacent buckets and nozzles forms a turbine stage and that additional stages are provided.

Interstage or packing seals are provided for sealing the inner hooks 24 of the diaphragm assemblies 20 against the rotor 16. The packing seals include a plurality of arcuate seal segments 34 disposed in generally dovetail-shaped grooves 36 of the inner hooks. The seal segments 34 have a plurality of radially inwardly projecting labyrinth seal teeth 38 for sealing against the rotor 16. The dovetail grooves 36 include axially extending flanges 40 and 42 which straddle a neck portion of the seal segment. Radially outwardly of the neck portions, the seal segments 34 have flanges 44 and 46 which cooperate with flanges 40 and 42 to maintain the seal segment mounted in the inner hook of the diaphragm assembly. As illustrated in FIG. 2, it will be appreciated that the seal segments are movable in generally radial directions to accommodate thermal transients and high and low portions of the rotor.

Figure 3:
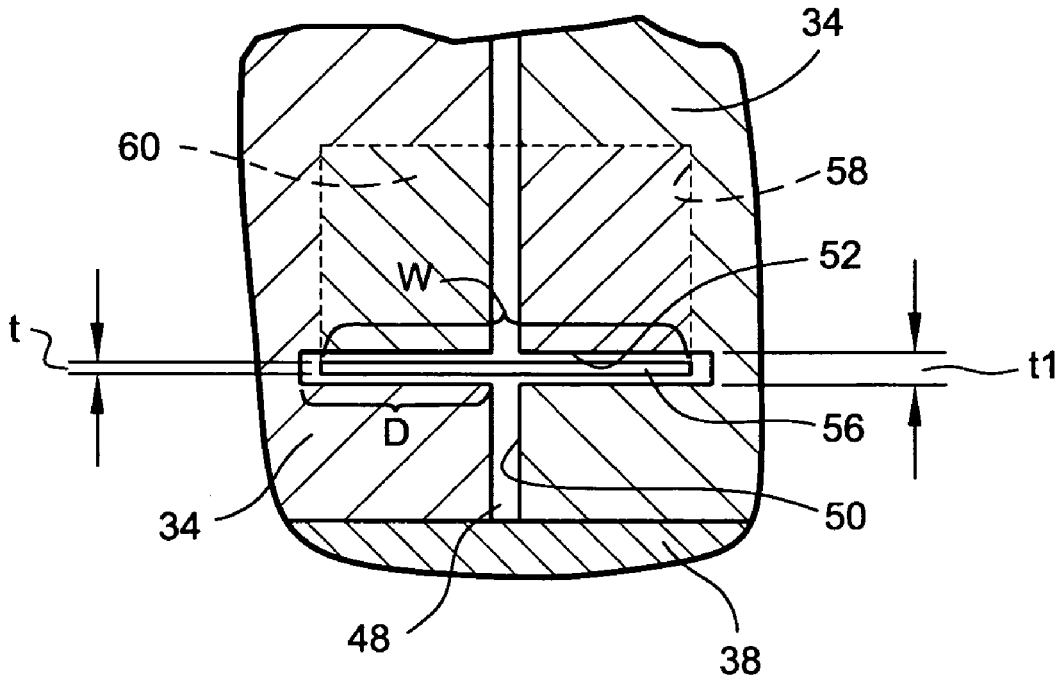
FIG. 3 is a fragmentary cross-sectional view taken along line 3—3 in FIG. 2 illustrating the end gap between adjacent seal segments and spline seals hereof in the gap.

Because the seal segments 34 move in generally radial directions and also because of machine tolerances and thermal transients during turbine operations, there is a gap 48 (FIG. 3) between the endfaces 50 of adjacent segments 34 which permits steam leakage flows between high and low pressure regions on opposite sides of the seal segments 34. It will be appreciated that any such steam leakage flow bypasses the flow path through the turbine without performing work in the turbine. To preclude the steam leakage flow through the gaps 48 between adjacent endfaces 50 of the seal segments 34, spline seals are provided between the adjacent endfaces 50. Particularly, slots are formed in each of the endfaces in registration with opposing endfaces for receiving spline seals. For example, as illustrated in FIG. 3, slots 52 are formed in each of the endfaces of adjacent seal segments and which slots 52 open circumferentially outwardly in registration with similar slots of adjoining seal segment endfaces. Slots 52 extend in axial and circumferential directions substantially the entire width of the seal segments 34 and adjacent the labyrinth teeth 38. A spline seal 56 disposed in the axially and circumferentially extending slots 52 precludes steam leakage flows in a generally radial outward direction.

Another slot 58 is formed in each of the endfaces 50. This second slot 58 extends in a generally radially outward inclined downstream direction in registration with a similarly disposed slot on the endface of the adjoining seal segment. A spline seal 60 is disposed in the inclined registering slots 58 and extends from a location adjacent the forward edge of the seal segment near the axially extending spline seal 56 and labyrinth teeth 38 to a location adjacent axial load and sealing surfaces between the seal segment and the inner hook. Each inclined spline seal 60 thus precludes or minimizes axial flow of leakage steam between high and low pressure regions on opposite sides of the seal segments 34 through the endface gaps 48. It will be appreciated that the neck of the seal segments and the inner hook flanges 42 form axial load surfaces on the downstream sides of the seals. Thus, with the inclined spline seals 60 extending from the low pressure side of seal segment 34 to a location adjacent the axial load sealing surfaces between the seal segments 34 and inner hook flanges 42, the extent of any gap between the endfaces is minimized.

It will be appreciated that any number of interstage packing seal segments 34 can be disposed circumferentially in the dovetail-shaped grooves 36 of the inner hooks 34. For example, three or more segments can be disposed in the upper half of the diaphragm assembly and a like number disposed in the lower half of the diaphragm assembly. Thus, in such arrangement, six endface gaps appear between the circumferentially adjacent segments.

Figure 4:
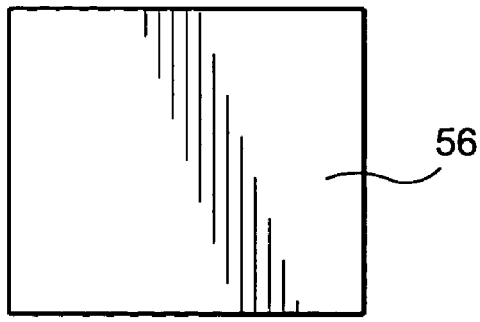
FIG. 4 is a plan view of a spline seal.

Referring to FIGS. 3 and 4, it will be appreciated that each of the first and second spline seals 56, 60 may comprise a flat metal plate as best illustrated in FIG. 4. The plate is generally rectilinear in shape. The thickness t of the plate is preferably less than the thickness t1 of the grooves to accommodate relative movement of the adjacent segments. Additionally, it will be appreciated that the endface gap seals for the sealing segments in accordance with this preferred embodiment of the present invention may be provided as part of original equipment manufacture or retrofitted into existing machinery. For example, to retrofit the spline seals 56, 60, an existing steam turbine is torn down, i.e., the upper casing is removed, and the seal segments are also removed, e.g., by rolling them circumferentially from the dovetail grooves 36 of the diaphragm assemblies. Slots, e.g., slots 52, 58, may then be formed in the endfaces of the seal segments to receive the spline seals. As illustrated in FIG. 3, spline seals 56 and 60 have widths W less than the combined depths D of the circumferentially registering slots of the opposed endfaces of the segments 34. With the grooves thus formed, the segments can be rolled back into the dovetail grooves of the inner hooks of the diaphragm assemblies with the spline seals inserted in the grooves between adjacent endfaces. Alternatively, of course, new packing seal segments with the grooves already formed may be used in lieu of forming grooves in the removed packing seal segments.

Figure 5:
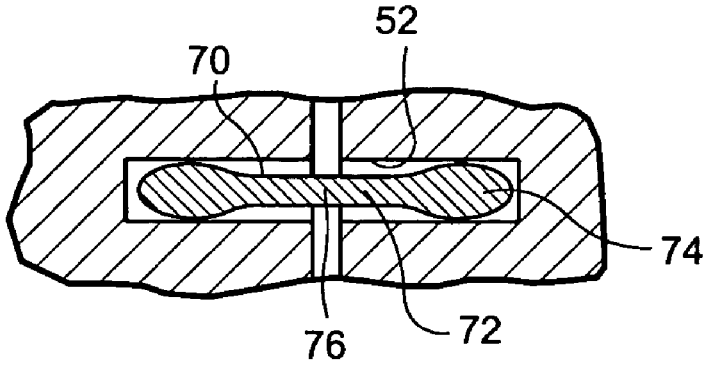
FIG. 5 is a fragmentary cross-sectional view of a further form of spline seal.
Figure 6:
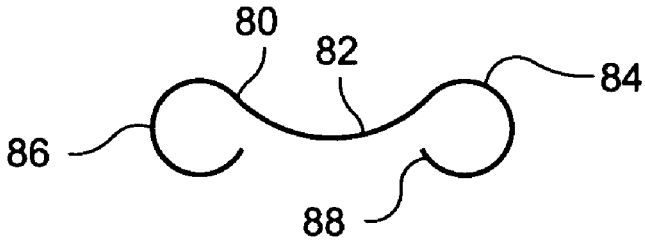
FIG. 6 is a schematic illustration of a still further form of spline seal.

Referring now to FIG. 5, another form of spline seal is illustrated in a slot or groove in the circumferentially opposed endfaces of the segments. The spline seal 70 may have a seal body 72 with enlargements 74 along opposite edges of the seal for disposition adjacent the bases of the groove. Thus, the central portion 76 of the seal body 72 has a reduced thickness dimension in comparison with the thickness of the slot, e.g., slot 52, and the enlarged ends, facilitating relative movement of the segments in a radial direction without damaging the spline seal 70. Spline seal 70 may be of the type disclosed in commonly owned U.S. Pat. No. 5,624,227, the disclosure of which is incorporated herein by reference. Spline seal 70 may be dimensioned relative to the slots 52 similarly as seal 34 is dimensioned relative to slots 52, i.e. seal 70 has a width less than the combined depths of the circumferentially registering slots of the opposed endfaces Referring now to FIG. 6, another form of spline seal is illustrated. The spline seal 80 of FIG. 6 may be formed of a sheet metal material having a seal body 82 with opposite ends reversely curved or bent at 84 to form enlargements 86 along opposite sides of the spline seal 80. Edges 88 of the reversely curved portions face the central portion of the seal body 82. The enlargements 86, like the enlargements of spline seals of FIG. 4, are disposed adjacent the bases of the slots and facilitate relative movement in a radial direction of the seal segments. This type of spline seal is also disclosed in the above patent.

Figure 7:
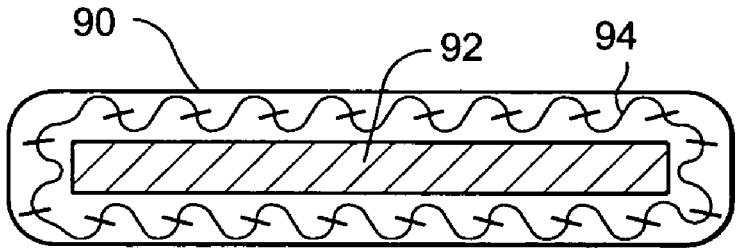
FIG. 7 is an enlarged cross-sectional view of a spline seal illustrating a metallic cloth covering therefor.

In FIG. 7, there is illustrated a spline seal 90 having a central core 92 formed of metal and having an overlay of cloth 94. The cloth layer may comprise a metal, ceramic and/or polymer fibers which have been woven to form a layer of fabric. The overlying cloth may be of the type disclosed in commonly-owned U.S. Pat. No. 5,934,687, the disclosure of which is incorporated herein by reference.

While the invention has been described in connection with what is presently considered to be the most practical and preferred embodiment, it is to be understood that the invention is not to be limited to the disclosed embodiment, but on the contrary, is intended to cover various modifications and equivalent arrangements included within the spirit and scope of the appended claims.

What is claimed is:

1. A steam turbine comprising:

a rotor carrying a plurality of circumferentially spaced buckets and forming a part of a stage of a steam turbine;

a diaphragm assembly surrounding the rotor including a plurality of nozzles and inner hooks and forming another part of the steam turbine stage;

said inner hooks carrying a plurality of circumferentially extending packing seal segments about said diaphragm assembly for sealing between said rotor and said diaphragm assembly;

each of said segments having endfaces respectively in circumferential registry with opposed endfaces of circumferentially adjacent segments, said endfaces including slots opening circumferentially and in general circumferential registration with one another, each said slot having a predetermined depth from said endface thereof; and a spline seal extending between each of said opposed endfaces of circumferentially adjacent packing ring segments and in said slots for minimizing or precluding steam leakage past said registering endfaces, the spline seal having a width less than the combined depths of said circumferentially registering slots of said opposed endfaces.

2. A turbine according to claim 1 wherein each said spline seal extends generally in axial and circumferential directions for sealing against leakage flows in generally radial directions.

3. A turbine according to claim 1 wherein said spline seal extends in a generally radially outwardly inclined downstream direction for sealing against steam leakage flows in a generally axial direction.

4. A turbine according to claim 1 wherein each said segment has a plurality of axially spaced labyrinth seal teeth for sealing with the rotor.

5. A turbine according to claim 1 wherein the spline seals extend generally in axial and circumferential directions for sealing against leakage flows in generally radial directions and second spline seals extending between opposed endfaces of circumferentially adjacent segments, said second spline seals extending in a generally radially outwardly inclined downstream direction for sealing against steam leakage flows in a generally axial direction.

6. A turbine according to claim 1 wherein said diaphragm assembly has a circumferentially extending groove having an axially extending flange, each said segment having a flange for radially overlying the diaphragm assembly flange, each said diaphragm assembly flange and each said segment having axially facing seal surfaces on a downstream side of said segments, said spline seals extending generally in axial and circumferential directions for sealing against leakage flows in generally radial directions.

7. A turbine according to claim 6 including second spline seals extending in generally radially outwardly inclined downstream and circumferential directions for sealing against steam leakage flows in a generally axial direction, said segments having a sealing face with said rotor including a plurality of labyrinth seals, said second spline seals extending substantially from said seal face along upstream sides of the seal segments in a generally radially outward downstream direction terminating adjacent said axially facing seal surfaces of said segments.

8. A turbine according to claim 1 wherein each said spline seal includes a cloth surrounding said spline seal along opposite sides thereof and about at least a pair of opposite edges thereof.

9. A turbine according to claim 1 wherein each said spline seal comprises a seal body having an enlargement along opposite edges and received in said slots with the enlargements adjacent bases of said slots, respectively.

10. A turbine according to claim 9 wherein said seal body is formed of sheet metal, said enlargements comprising integral bent margins of said sheet metal spline seal having edges facing central portions of said sheet metal spline.

11. A turbine according to claim 1 wherein said slots have a predetermined depth between opposite side walls thereof, each said spline seal having a thickness less than the depth of said opposed slots and comprised of a flat non resilient plate.

12. A steam turbine comprising:

a rotor carrying a plurality of circumferentially spaced buckets and forming part of a stage of a steam turbine;

a diaphragm assembly surrounding the rotor including a plurality of nozzles and inner hooks and forming another part of the steam turbine stage;

said inner hooks forming a circumferentially extending dovetail shaped groove carrying a plurality of circumferentially extending packing seal segments about said diaphragm assembly in said groove, said segments carrying labyrinth seal teeth for sealing about said rotor and being movable in a generally radial direction in said groove;

each of said segments having endfaces respectively in circumferential registry with opposed endfaces of circumferentially adjacent segments, said endfaces including slots opening circumferentially and generally in circumferential registration with one another, each said slot having a predetermined depth from said endface thereof; and a spline seal extending between each of said opposed endfaces of circumferentially adjacent segments and in said slots for minimizing or precluding steam leakage flow past said registering endfaces, said spline seal having a width less than the combined depths of said circumferentially registering slots of said opposed endfaces.

13. A turbine according to claim 12 wherein each said spline seal extends generally in axial and circumferential directions for sealing against leakage flows in generally radial directions.

14. A turbine according to claim 12 wherein each said spline seal extends in generally radially outwardly inclined downstream and circumferential directions for sealing against steam leakage flows in a generally axial direction.

15. A turbine according to claim 12 wherein each spline seal extends generally in axial and circumferential directions for sealing against leakage flows in generally radial directions and a second spline seal extending between each of said opposed endfaces of circumferentially adjacent segments, said second spline seal extending in generally radially outwardly inclined downstream and circumferential directions for sealing against leakage flows in a generally axial direction.

16. A turbine according to claim 12 wherein said groove of said diaphragm assembly has an axially extending flange, each said segment having a flange for radially overlying the diaphragm assembly flange, said diaphragm assembly flange and said segments having axially facing seal surfaces on downstream sides of said segments, said spline seals extending generally in radial and circumferential directions for sealing against leakage flows in a generally axial direction.

17. A turbine according to claim 16 including second spline seals extending in generally radially outwardly inclined downstream and circumferential directions for sealing against steam leakage flows in a generally axial direction, said segments having a sealing face with said rotor including a plurality of labyrinth seals, said second spline seals extending substantially from said seal face along upstream sides of the seal segments in a generally radially outward downstream direction terminating adjacent said axially facing seal surfaces of said segments.

18. A turbine according to claim 12 wherein said spline seals include a cloth surrounding each said spline seal along opposite sides thereof and about at least a pair of opposite edges thereof.

19. A turbine according to claim 12 wherein each said spline seal comprises a seal body having an enlargement along opposite edges and received in said slots with the enlargements adjacent bases of said slots, respectively.

20. A turbine according to claim 19 wherein said seal body is formed of sheet metal, said enlargements comprising integral bent margins of said sheet metal spline seal having edges facing central portions of said sheet metal spline.

21. In a turbine having a rotor, a diaphragm assembly surrounding the rotor and a plurality of circumferentially extending packing seal segments in circumferentially extending grooves about said diaphragm assembly for sealing between the diaphragm assembly and the rotor, a method of retrofitting the packing seal segments to provide seals between the opposed endfaces of adjacent packing seal segments comprising the steps of:

removing the packing seal segments from the turbine;

forming at least one slot in each endface of the removed packing seal segments to a predetermined depth from the endfaces thereof;

disposing a spline seal in slots of opposed endfaces of the packing seal segments with the spline seal having a width less than the combined depths of said slots of the opposed endfaces; and inserting the packing seal segments into the grooves of the diaphragm assembly with at least one of the edges of the spline seal spaced from a base of one of said grooves whereby the spline seals extend between adjacent segments for minimizing or precluding steam leakage flows between said adjacent segments.

22. A method according to claim 21 including forming two slots in each endface of the removed packing seal segments, and disposing a spline seal in each slot of the opposite endfaces whereby the two spline seals extend between the adjacent segments in assembly of the segments in the turbine.

23. A method according to claim 22 including forming one of said two slots in the endfaces in generally axial and circumferential directions, forming another of said two slots in the endfaces in a generally radially outward downstream direction, disposing spline seals in said slots to minimize or preclude steam leakage flows in generally radial and axial directions, respectively.

24. A turbine according to claim 12 wherein said slots have a predetermined depth between opposite side walls thereof, each said spline seal having a thickness less than the depth of said opposed slots and comprised of a flat non resilient plate.

* * * * *